US005120392A

United States Patent [19]

Butkevich et al.

[11] Patent Number: 5,120,392

[45] Date of Patent: Jun. 9, 1992

[54] CONTAINER TRANSPORT AND MANIPULATOR FOR USE WITH A LABEL OR SCREEN PRINTING APPLIER

[75] Inventors: David Butkevich; Daniel M. Zubik, both of Watertown, Conn.

[73] Assignee: Screen-Tech Inc., Oakville, Conn.

[21] Appl. No.: 703,300

[22] Filed: May 20, 1991

[51] Int. Cl.[5] ..... B65C 9/00

[52] U.S. Cl. ..... 156/566; 101/40.1; 198/375; 198/379; 198/621; 198/774.3

[58] Field of Search ..... 156/566; 101/39, 40, 101/40.1; 198/375, 379, 468.2, 468.4, 621, 774.3, 775

[56] References Cited

U.S. PATENT DOCUMENTS 2,904,192 9/1959 Reynolds et al. ..... 198/375
4,122,768 10/1978 Dubuit et al. ..... 101/39
4,398,627 8/1983 Saccani ..... 101/40.1

FOREIGN PATENT DOCUMENTS 2453064 5/1975 Fed. Rep. of Germany ..... 101/40.1

*Primary Examiner*—Joseph E. Valenza
*Attorney, Agent, or Firm*—Dallett Hoopes

[57] ABSTRACT

A container transport and manipulator includes opening and closing beams mounting therealong spaced supports for engaging the ends of parallel horizontally disposed containers, and a swing platform, timed with the supports, for carrying the containers from one support to the next. The final support at the labeling or printing station rocks or manipulates the containers about the axis of curvature of the curved surface on which a label or printing is applied so that the labeling or printing can be smoothly and quickly done in reliable fashion. The final support is quickly set up and changed for different-shaped containers.

8 Claims, 7 Drawing Sheets

CONTAINER TRANSPORT AND MANIPULATOR FOR USE WITH A LABEL OR SCREEN PRINTING APPLIER

BACKGROUND OF THE INVENTION

1. Field of the Invention

This invention relates to a container transport and manipulator for use with a labeling or printing applier for applying labels or screen printing to the containers. More specifically, this invention relates to such a transport for use with containers of diverse non-cylindrical shapes. The apparatus provides a support to rock the container at the labeling or printing station in a path which facilitates the labeling or printing.

2. Description of Related Art Including Information Disclosed Under §§1.97 to 1.99

The prior art contains a number of patents which relate to screen imprinting of images on objects. An example is U.S. Pat. No. 4,048,914 which issued Sep. 20, 1977 to Kammann et al. In this patent horizontally disposed containers are carried step-by-step fashion by grippers engaging the ends of the containers and the containers are rolled over a hump or "guide member" where the printing is applied. The purpose of the hump is to move the container at the printing station in a path so that the container engages the printing means evenly.

There have been some drawbacks in the apparatuses of the prior art. A major drawback has been the difficulty of setting up of the transport apparatus to accommodate the configuration of a new non-cylindrical container.

SUMMARY OF THE INVENTION

The present invention is a transport and manipulator having readily changeable means for adapting it to a new and different shape of irregular container so that the apparatus is ready to deal with a container of a different shape in a minimum amount of set-up time.

An essential of the invention is a pair of spaced rocker arms mounted to grab and support the container and rock the container at the printing or labeling station about the axis of curvature of the work surface on which the printing or labeling is performed. While this is going on, the labeling or printing applier is performing on the work surface. The work surface may be convex or concave. Means are provided for moving the containers one-by-one from a supply into the rocker arms and for indexing the containers to proper orientation to be received by the arms.

BRIEF DESCRIPTION OF THE DRAWINGS

Other features and objects of the invention will be apparent from a review of the following specification, including the drawings, all of which disclose a non-limiting embodiment of the invention. In the drawings.

DESCRIPTION OF THE PREFERRED EMBODIMENT

As stated, the present invention is a transport and manipulator for non-cylindrical containers to move them so that a label or screen printing can be applied to a non-cylindrical work surface thereon. For simplicity, the specification hereafter treats the apparatus as a transport and manipulator for a labeling operation. However, it should be understood that screen printing can be applied to the container at the same position that the label is applied.

CONTAINER SUPPORTS AND CARRIERS

Figure 1:
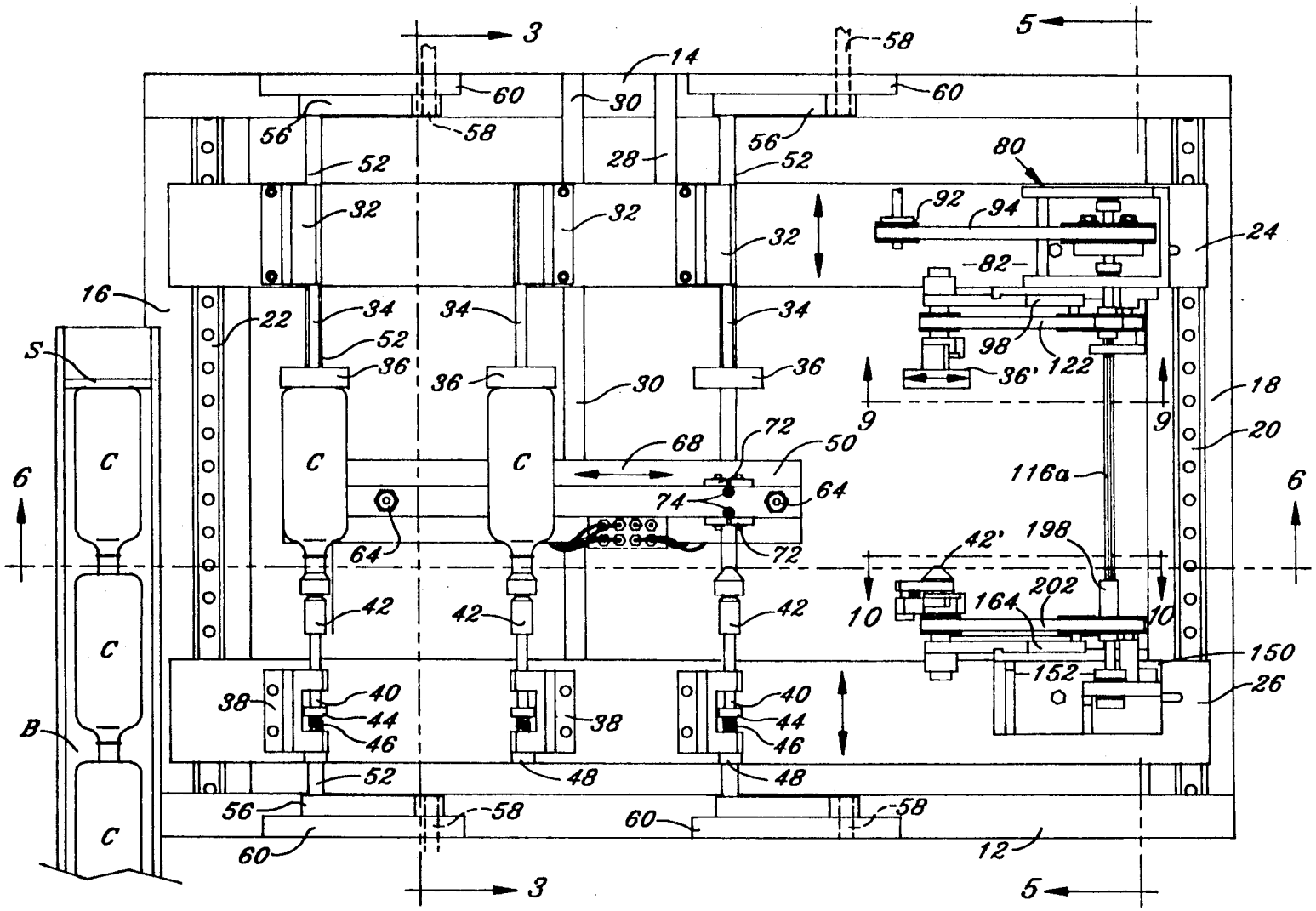
FIG. 1 is a top plan view of an apparatus embodying the invention showing the cups and spears gripping the successive containers.

An apparatus embodying the invention is generally designated 10 in FIG. 1. It comprises a frame having horizontal sill plates 12 and 14 and rear channel member 16 and a front channel member 18. The front and rear channel members are provided on their top suffaces with anti-friction tracks 20 and 22 respectively. On these tracks ride the opposite ends of a pair of beams designated a cup beam 24 and a spear beam 26. The cup beam and spear beam are moved on the tracks rhythmically toward and away from each other by reciprocating rods 28 and 30 respectively driven by means not shown.

Spaced along the cup beam 24 are mounted cup standards 32, each supporting adjustably by means not shown, horizontal shafts 34, the ends of which carry cups 36. Cups 36 each have a central depression and face inward of the machine. The shape of the depression in each of the cups accommodates the shape of the bottom end of the selected container C to be worked upon.

The spear beam 26 has mounted on it a number of spear standards 38. Each standard at its upper end carries a pair of horizontally aligned bearings through which fit a shaft 40 carrying on its end a spear 42 facing the cups thereopposite respectively. The shaft may be provided intermediate the bearings with a flange 44, and a compression spring 46 disposed between the flange 44 and the bearing farthest away from the spear 42, urges its spear 42 toward its cup 36.

Figure 2:
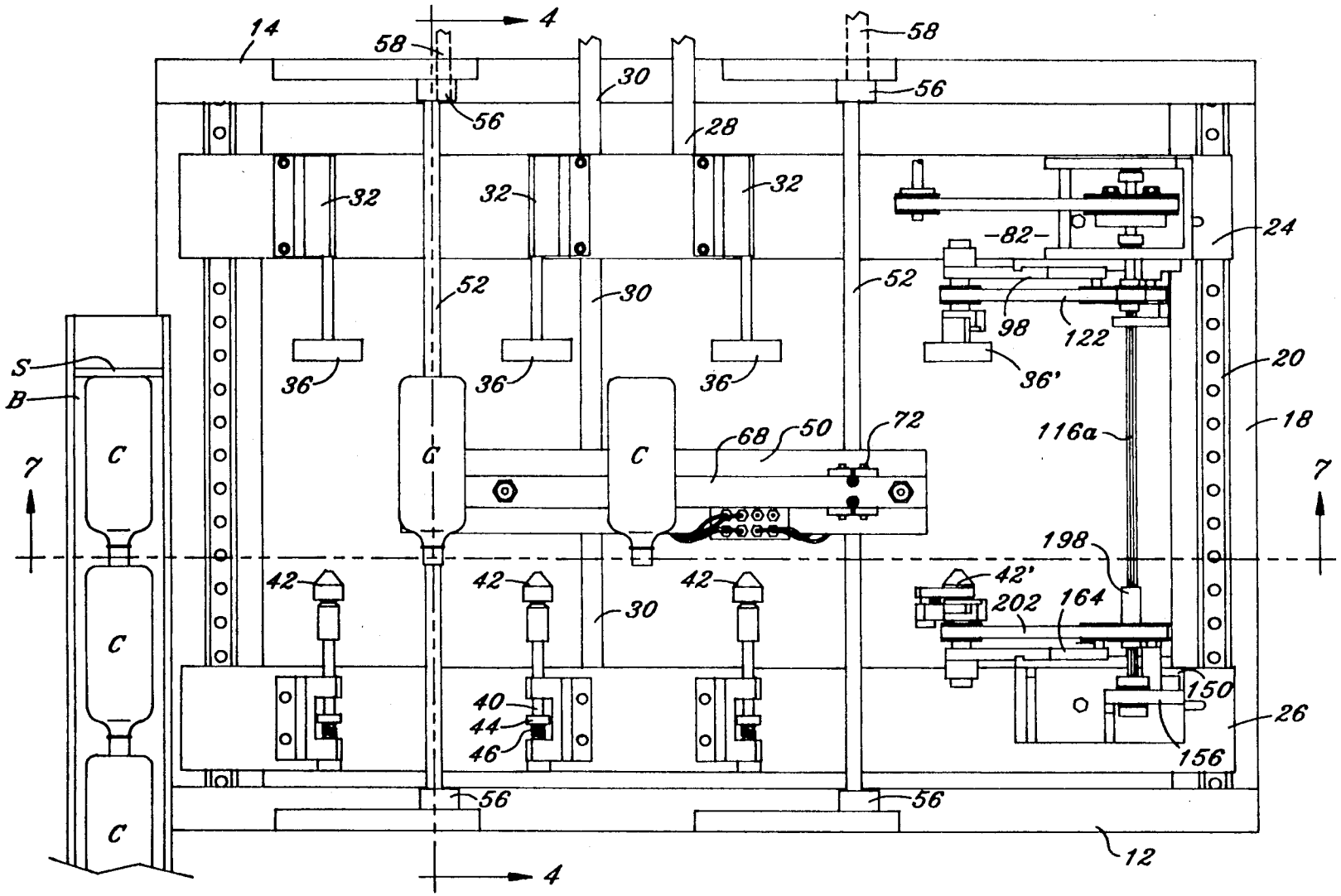
FIG. 2 is comparable to FIG. 1 but showing the cups and spears spread and the containers being supported and moved on the swing platform.

The containers C handled by the apparatus are horizontally disposed. It will be noted that in the closed position (that is the position in which the beams 24, 26 are at the ends of their travel more inward of the apparatus), of the cup beam 24 and the spear beam 26 the containers C are compressively gripped by their bottom and top ends between the respective cups 36 and spears 42, the spears intruding into the mouths of the respective containers C. When the cup beam 24 and the spear beam 26 are open (FIG. 2), the containers are released and can pass between them freely. The cups 36 and spears 42 and related structure comprise the container supports.

Disposed between the cups 36 and spears 42, as seen from above FIG. 1, is an elongated swing platform 50. This platform 50 is supported on a pair of horizontal parallel support rods 52 which are journaled in bearings (not shown) and extending downward from the platform 50. The rods 52 are pivotally supported at each of their ends by parallel swing arms 56. At their upper ends the parallel swing arms 56 have perpendicular shafts 58 which pivot in uprights 60. The shafts 58 are driven in oscillating fashion by power means not shown.

Figure 6:
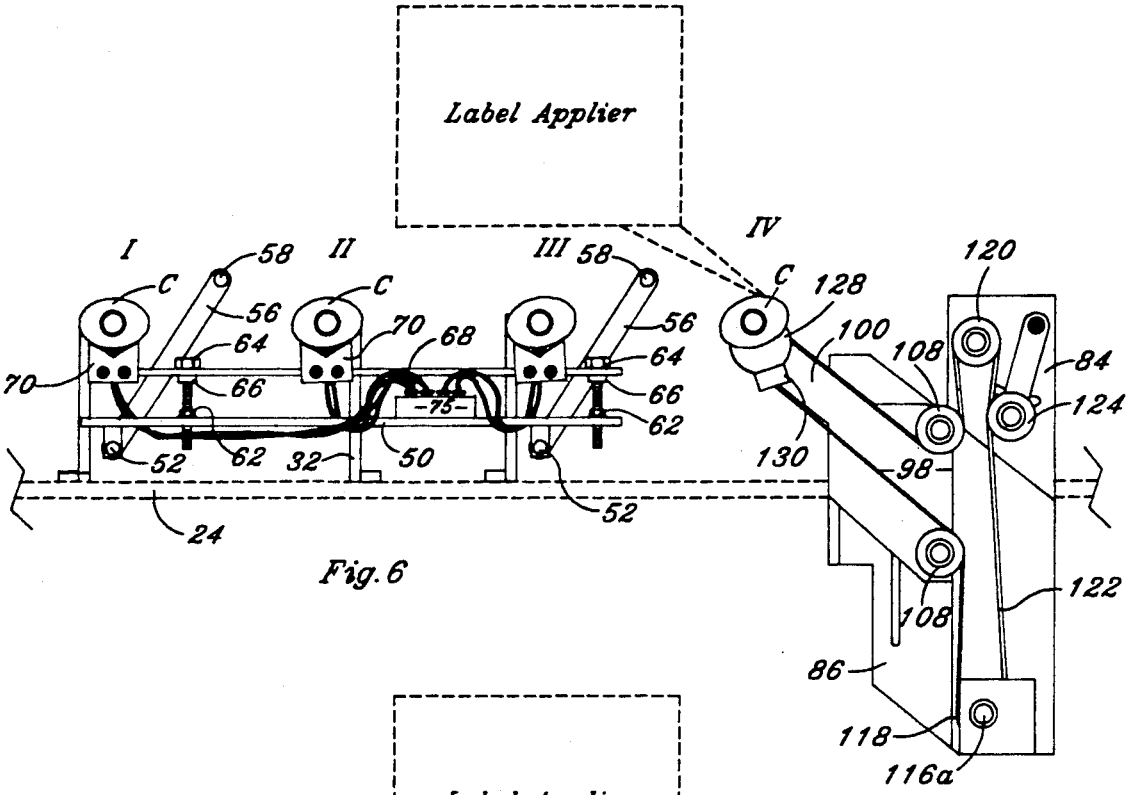
FIG. 6 is a simplified view taken on the line 6—6 of FIG. 1.

Intermediate the center of the swing bed 50 and its opposite ends are respective apertures over which are secured nuts 62 (FIG. 6). Into these nuts are operatively received threaded rods on the top of which are mounted adjusting knobs 64. Spaced downward on the rods from the knobs 64 are support flanges 66, and between the knobs and flanges 66 is supported the top deck 68 of the swing platform 50.

Figure 3:
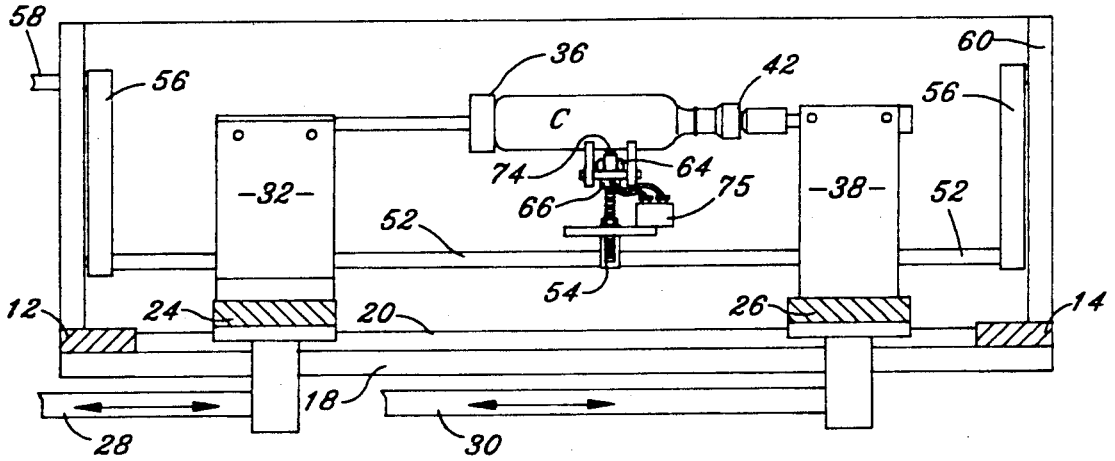
FIG. 3 is a sectional view taken on the line 3—3 of FIG. 1.
Figure 4:
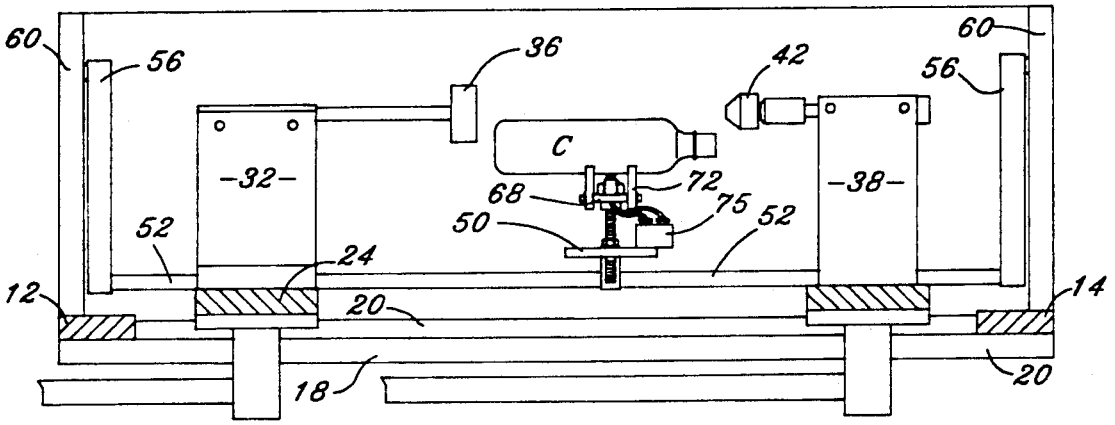
FIG. 4 is a sectional view taken on the line 4—4 of FIG. 2.
Figure 7:
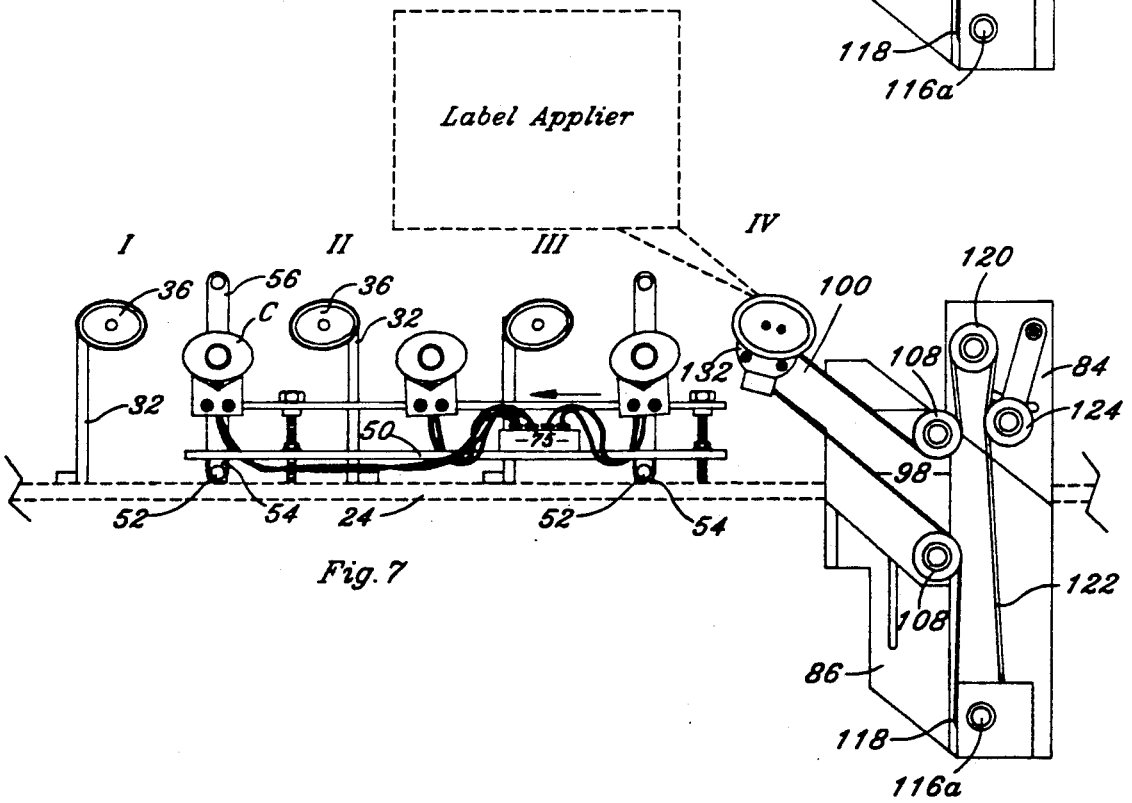
FIG. 7 is a simplified view taken on the line 7—7 of FIG. 2.

Spaced uniformly along the top deck 68 are container horses 70, each of which comprise parallel end plates 72 which are aligned and bolted onto the top deck (FIGS. 1, 3). As shown (FIG. 6), the horses have a broad V-shaped opening in their upper face. The openings of each horse are adapted to receive in sawhorse fashion a container C (FIGS. 6, 7). Intermediate the end plates 72 the deck 68 mounts preferably a pair of vacuum intake lips 74 (FIG. 1) for better gripping the containers C. Intakes 74 are connected to a manifold 75 central of the platform 50. Vacuum is furnished by a supply not shown.

It should be noted that the horses 70, are canted so that the containers C, are tipped for reasons which will appear. The horses, swing platform and related structure comprise the container carriers.

SYNCHRONY OF MOVEMENT

Figure 5:
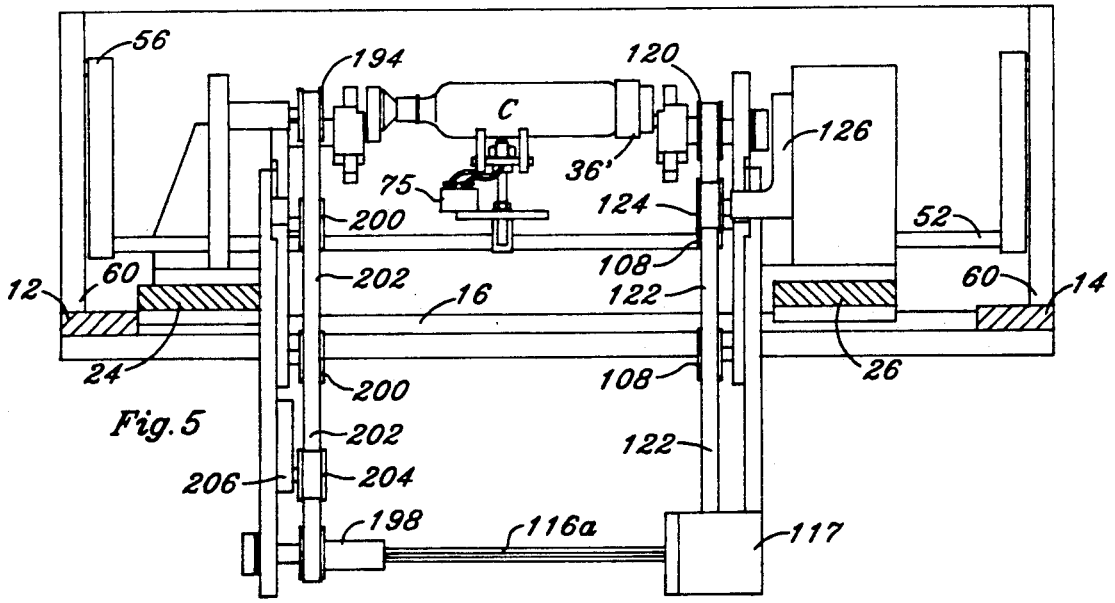
FIG. 5 is a sectional view taken on the line 5—5 of FIG. 1 and showing a label applier in phantom.

It will be noted that the spacing between the horses 70 and the cups 36 and spears 42 (FIGS. 5, 6) is identical and that the swing of the arms 56 and the height of the containers C above the swing platform 50 is such that at the opposite ends of the swing travel of the arms 56 the containers align with the adjacent cups 36 and spears 42.

The synchrony of the motion of the components is such that in FIG. 6 the cup 36 and spear 42 grip the container C at the first station I, the cup beam 24 and the spear beam 26 being closed. Then successively the cup beam 24 and the spear beam 26 open (FIG. 2) and the swing arm 56 swings the swing platform 50 rightwardly to its rightward end of travel so that the container which had been at the first station is now lined up with the cup 36 and spear 42 at the second station II. At this point the cup beam 24 and spear beam 26 close to grip the container in the second station.

In this manner the containers proceed step-by-step in a rightward direction to the third station III, and so on. By means not shown, vacuum intake lips 74 (FIG. 1) are activated but only during the time in which the swing platforms 56 are actually swinging, the vacuum being cut off when the containers are gripped by the cups 36 and spears 42 at the respective stations.

MANIPULATION AT LABELING STATION

The support for containers (FIG. 8) used at the labeling station IV comprises the cup 36' and the spear 42' mounted on the respective beams 24, 26. Otherwise it is very different from the container support at the first, second and third stations. It is the object of the mechanism at the labeling station to manipulate the container C under the label applier (FIG. 6) in a manner such that the work surface on which the label is to be applied moves along its arc of curvature. This requires that the container be pivoted about the axis of the arc of curvature.

Figure 8:
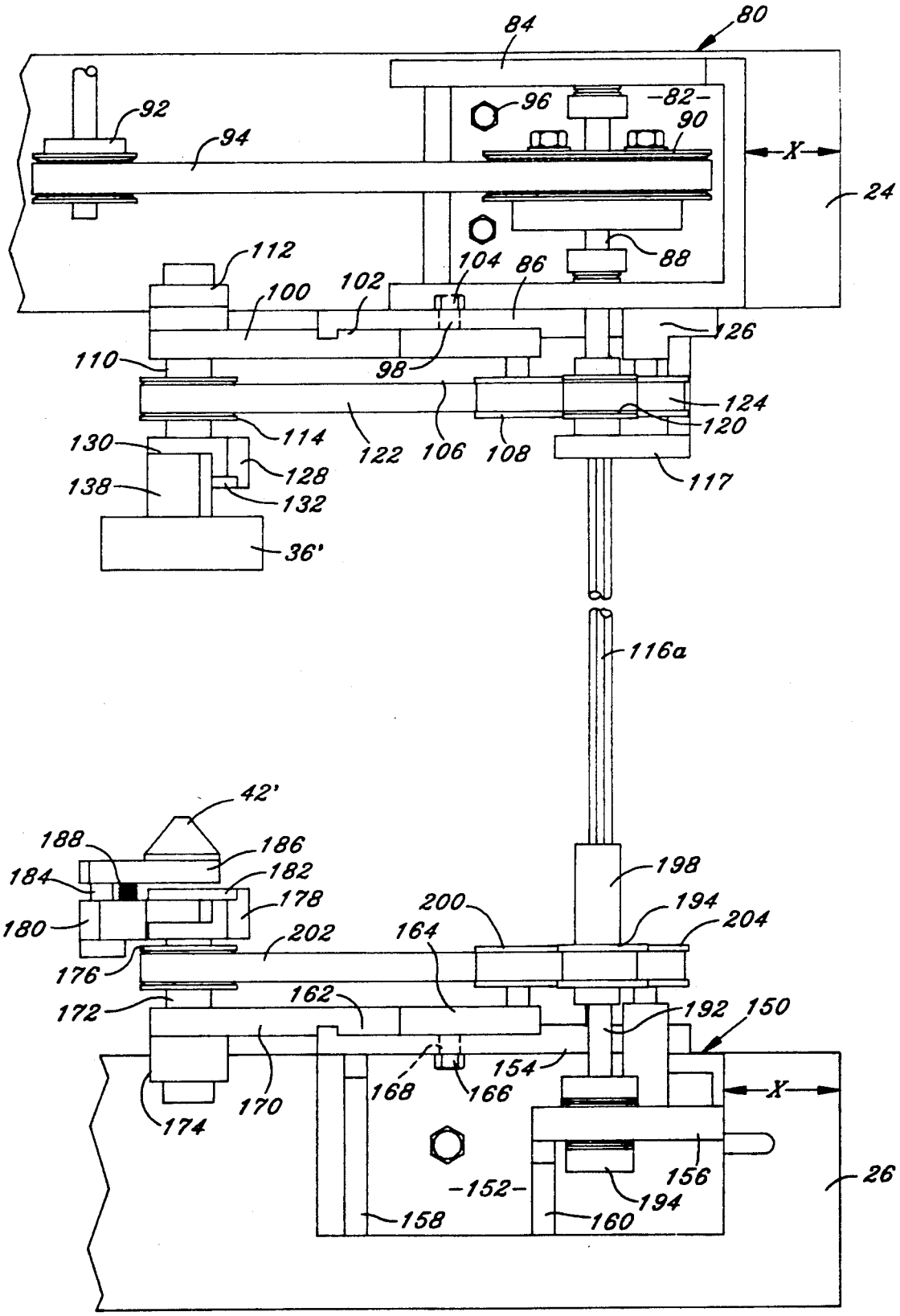
FIG. 8 is an enlarged top plan view of the container support at the labeling station.

The cup support mount at the labeling station is generally designated 80 in FIG. 8. It comprises a base plate 82 to which are secured a pair of vertical plates 84 and 86 which journal shaft 88 which carries pulley 90. Pulley 90 is powered in oscillating fashion by drive pulley 92 and belt 94. Pulley 92 is on shaft 93 driven by means not shown.

Wall 86 extends downward inside bed 24 as well as upward from the base plate 82. The mount 80 is adjustably secured to the beam 24 in the appropriate position therealong by bolts 92. Suitable tensioning means may be provided for belt 94.

Figure 9:
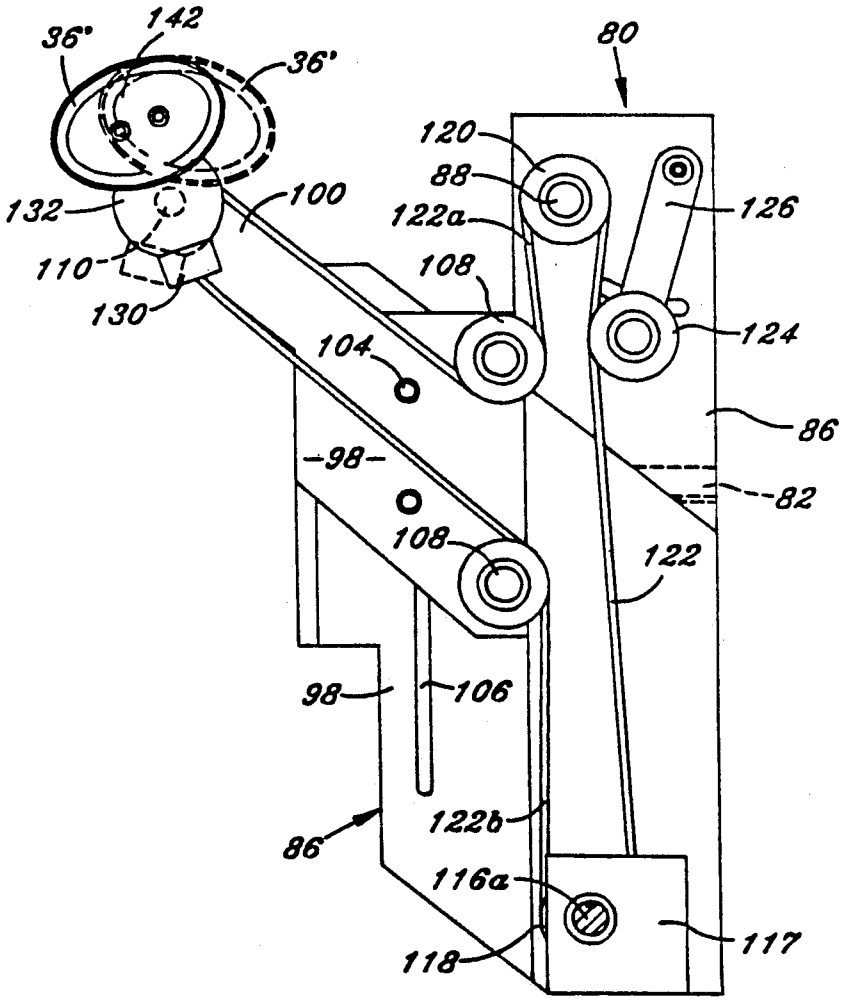
FIG. 9 is an enlarged elevational view taken on the line 9—9 of FIG. 1 and showing part of the mechanism for manipulating the container at the labeling station. An alternate position of the mechanism is shown in phantom.

Vertically slidable on the wall 86 of baseplate 82 is the cup arm pivot plate 98. Plate 98 which has an upwardly angled arm 100 is held in a selected vertical position in a shallow channel 102 in the wall 86 of the frame by bolts 104 which extend through a slot 106 (FIG. 9). The pivot plate 98 mounts a pair of idlers 108 spaced as shown. Toward the upper end of the arm 100 a cup rocker shaft 110 (FIG. 8) is journaled in a substantial bearing block 112 and carries a rocker drive pulley 114. At the lower end of the wall 86 is journaled a shaft 116 (FIG. 9) between wall 86 and bracket 117 parallel to shafts 110 and 96. Shaft 116 carries the lower end pulley 118 and extends inward in a splined portion **116*a*. Shaft 88 carries an upper pulley 120**.

The pulleys 114, 118 and 120 are timing belt pulleys and a timing belt 122 is trained thereover and held inward by the idlers 108 which engage the back of the belt 122 as shown (FIG. 9). Idler 124 is rotatably mounted on the arm 126 pivoted to plate 86 as shown. By virtue of this arrangement, the pulley 114 and its shaft 110 may be vertically adjusted by raising or lowering the plate 98 on the wall 86. The adjustment is possible without changes of belt length because the sum of the lengths of run **122*a* of the belt above the idlers 108 and run 122*b* below the idlers is always the same. An idler 124** keeps the belt under proper tension.

At the end of the shaft 110 toward the centerline of the apparatus is mounted a U-shaped clamp 128 (FIG. 8) which receives the cup rocker arm 130. Secured against the outer ends of the U-shaped clamp 128 is the clamping plate 132 which is apertured and provided with suitable fastener means to releasably fix the arm 130 in the clamp in the appropriate position for a given shaped container. Preferably, as shown, the distal end of the arm 130 carries a mounting plate 138. Cup 36' is secured to the plate 138 by fasteners 142 as shown in FIG. 9.

Figure 10:
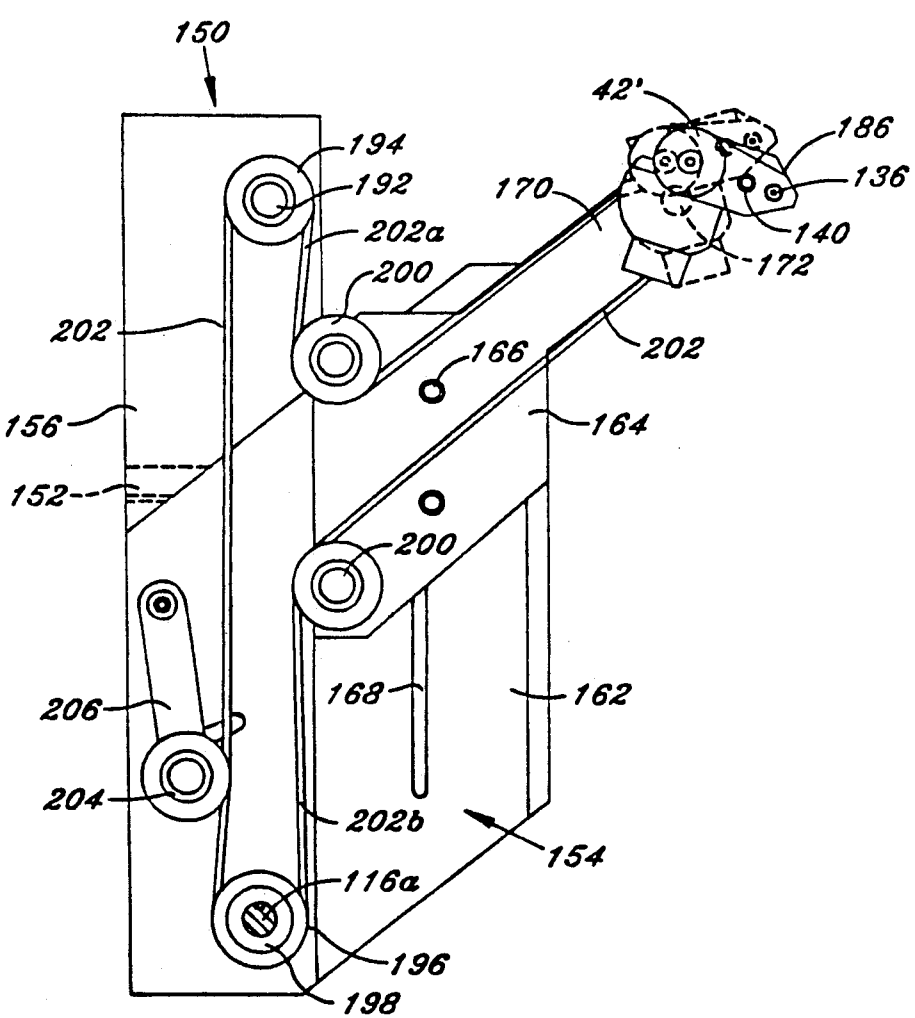
FIG. 10 is a sectional view of slightly larger scale than FIG. 9 taken on the line 10—10 of FIG. 1.

Adjustably secured along the spear beam 26 is the labeling station spear support mount 150 (FIGS. 8, 10). The mount 150 includes a base plate 152 held in place on beam 26 by bolts as shown, and spaced vertical wall 154 extending upward and downward and spaced vertical wall 156. Webs 158 and 160 support the walls respectively. As with wall 86, wall 154 is formed with a shallow channel 162 and extends downward as well as up. A spear arm pivot plate 164 is vertically adjustable along the channel 162 on the plate 154 being fixable in position by bolts 166 passing through a slot 168 in the wall 154. Plate 164 has an upward arm 170 (FIG. 10).

A spear rocker shaft 172 (FIG. 8) is journaled in a bearing 174 on arm 170. The shaft 172 extends inward of the apparatus toward the centerline and mounts pulley 176. At its inward end the shaft 172 is provided with a U-shaped clamp 178 which receives an L-shaped spear rocker arm 180 which is clamped in the U-shaped clamp 178 by the clamping plate 182 at a selected distance there-along.

The perpendicular upper end of the rocker arm 180 is appertured to receive a headed pin 184 to the inner end of which is secured a spear mounting plate 186. A compression spring 188 urges the mounting plate 186 inward of the apparatus. To the mounting plate 186 is secured the spear 42'.

Compressed air may be supplied to the container C through the spear 42' to make it more rigid in the labeling operation if desired or necessary.

As shown in FIGS. 9 and 10, the spear and cup supporting and driving assemblies are mirror images. In the lower end of the wall 154 is journaled a shaft 190. In the upper end of wall 156 is journaled shaft 192 carrying pulley 194. A pair of spaced idlers 200 are mounted on the plate 164. Lower shaft 190 carries the spline pulley 196 being a combined timing belt pulley and a spline socket 198 which operatively receive the splined portion 166*a*.

The pulleys 194, 196 and 176 are timing belt pulleys and the timing belt 202 is trained thereover and held inward by the idlers 200 which engage the back of the belt 202 as shown (FIG. 10). By virtue of this arrangement, changes in the height of the pulley 176 may be made by raising or lowering the plate 164 on the wall 154. Here again the adjustment is possible without changes of belt size because the sum of the lengths of the run 202*a* of the belt above the idlers 200 and run 202*b* below the idlers is always the same. An idler 204 carried on pivoted arm 206 secured to wall 154 engages the back of the belt 202 and keeps the belt 202 under proper tension.

SETTING UP THE APPARATUS

In setting up the apparatus for manipulating a given shape container, the parts described above are proportioned so that it is only necessary to make three sets of adjustments of the labeling station spear and cup supports. First, the dimension X (FIG. 8) of the mounts 80, 150 from the rightward end of the respective beams 24, 26 must be fixed at the proper distance, identical for the two mounts. Second, the dimension Y of the cup pivot plate 98, down from the top of the wall 86, (FIG. 11) and the top of the spear pivot plate 164, down from the top of wall 154 (FIG. 11) must be set to the proper identical distance. (The equal settings of dimensions X and Y assure that shafts 110 and 172 are coaxial.) Thirdly, the dimension indicated as Z in FIG. 11, from the center of the cup 36' to the axis of the shaft 110 and the distance from the center of the spear 42' to the axis of shaft 172 also indicated Z in FIG. 10 must be set to the proper identical distance.

Thus, a total of six adjustments is all that is necessary to set up the cup and spear mounts at the labeling station IV to properly manipulate the container over the labeler. The value of these various dimensions X, Y and Z can be determined by measurements taken from the container C itself taking into consideration the position of the label dispenser outlet.

Figure 12:
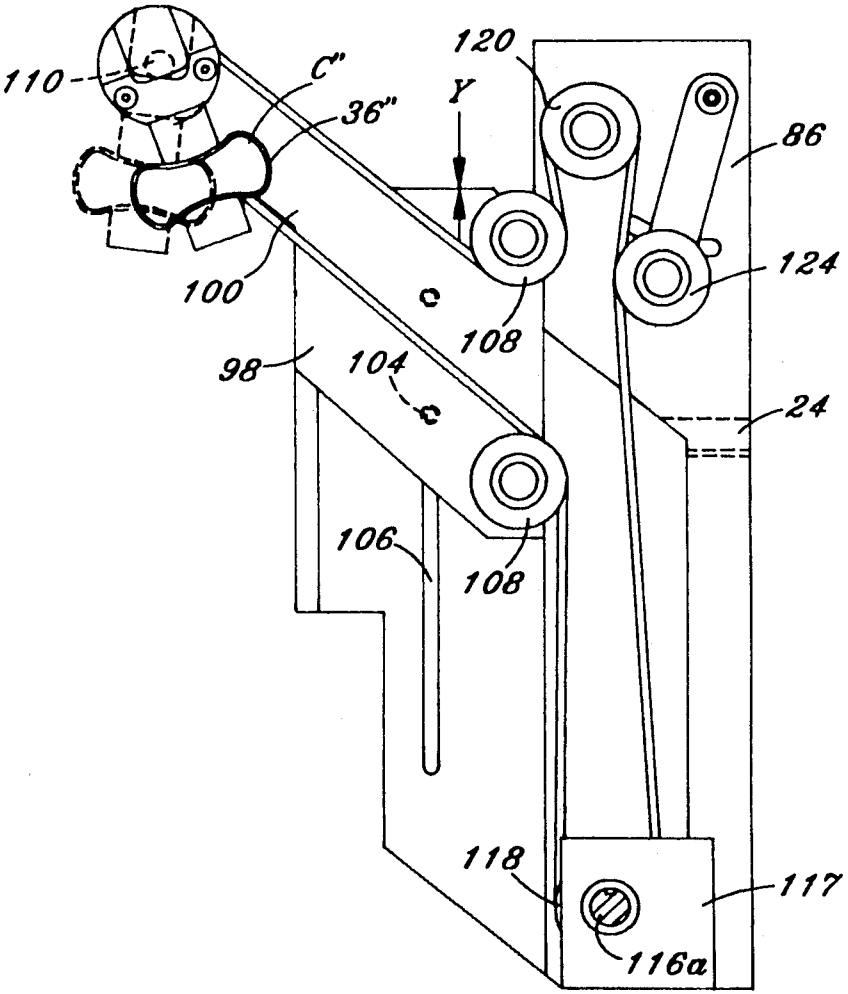
FIG. 12 is comparable to FIG. 11 but showing the mechanism set up to manipulate a container having a concave work surface.
Figure 11:
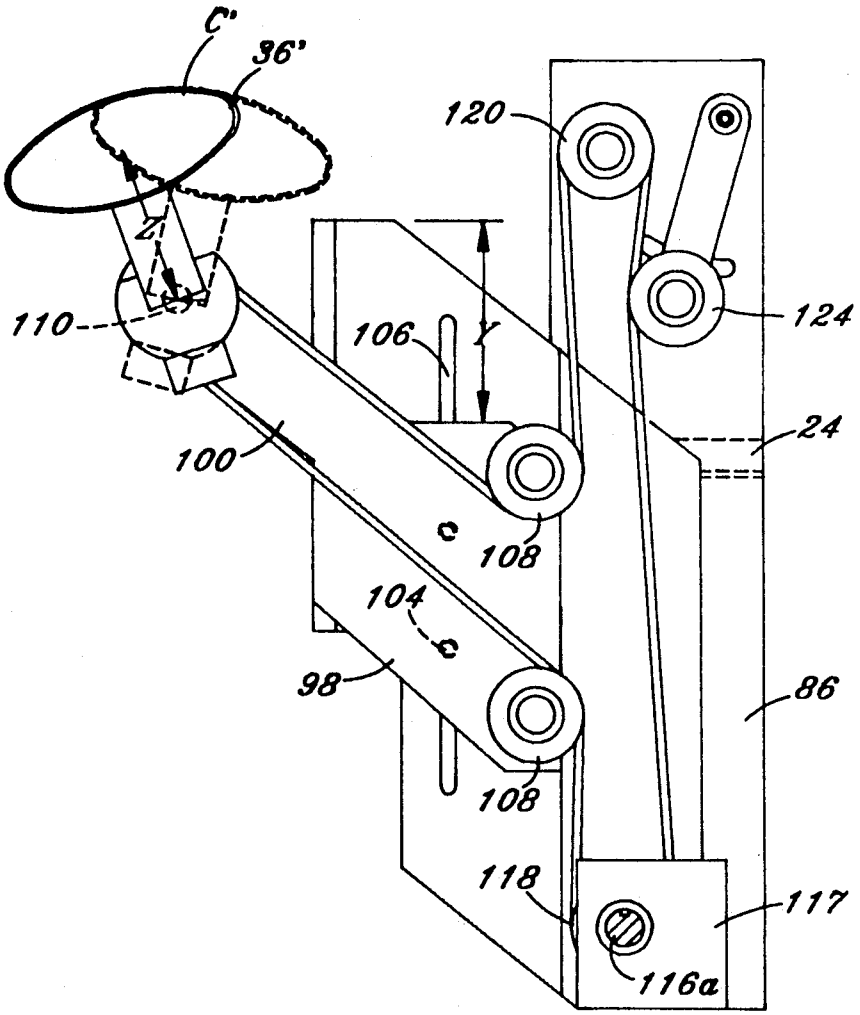
FIG. 11 is comparable to FIG. 9 but enlarged and showing the mechanism set up for labeling a container of larger center of curvature on the labeling work surface.

FIGS. 11 & 12 are comparable to FIG. 9, but show the units at station IV set up for containers having label working surface of diverse shapes. In FIG. 11 the container C' is a flatter oval so that the distance Z from the center of the cup 36' (shaped to accommodate the new shape) to the axis of shaft 110 must be greater than with the FIG. 9 container as arm 130 is moved in clamp 128 accordingly. Because of this, the height of the shaft 110 must be lowered to keep the working surface at the level of the label dispenser. Hence, the distance Y must be increased. Obviously, these set-up steps must be duplicated for the spear settings Y and Z (FIG. 10).

FIG. 12 shows the station IV cup mount set up to receive a container C" having a concave label working surface. In this case the cup 36", appropriately shaped, is disposed on the arm under the axis of the shaft 110 as arm 130 is moved in clamp 128 accordingly. Because cup 36" is beneath the shaft 110, the distance Y is reduced, plate 98 being fixed high on the mount. Similar changes are made on the spear mount IV. Also, because the container 36" is below the shaft 110, it will be 180° out of phase with the rest of the apparatus, the rocker arm 130 will have to be suitably repositioned with respect to shaft 110.

OVERALL OPERATION

While the operation of the apparatus has been described piecemeal hereabove in connection with the structure of the various components, the operation will now be summarized and elaborated somewhat.

With the apparatus described in operation, lined up containers C disposed horizontally end-to-end on conveyor B are lifted up one-by-one by a vacuum picker (not shown).

With beams 24 and 26 open (FIG. 2), the vacuum picker moves the next available container C from against the stop S to a position between the cup 36 and the spear 42 at the first station I (FIG. 6). The container is in a slightly canted attitude for reasons which will appear. The beams 24, 26 close (FIG. 1) and the cup engages the lower end of the container C and the spear 42 engages into the mouth of the container C, the cup and spear compressively gripping the container C.

As the beams 24, 26 open and close, the splined portion 116*a* slides easily inward and outward of the splined socket 198 smoothly transmitting to pulley 196 the oscillating drive of the splined portion 116*a*.

The swing platform 50 then swings to a position in which the first horse 70 on the left (FIG. 6) is disposed under the container C at the first station and the vacuum lips 74 thereon are activated to engage the container. The beams 24, 26 then open leaving the container C supported on the horse 70 at the first station.

The swing platform 50 swings rightward (FIG. 7) until the container C lines up with the cup 36 and spear 42 at the second station II. The beams 24, 26 close. The vacuum lips 74 are deactivated and the swing platform 50 swings leftward (FIG. 6) so that the second horse lines up under the cup 36 and spear 42 at the second station II.

The vacuum lips are activated and the beams 24, 26 open leaving the container supported on the second horse. After the beams 24, 26 open, releasing the container, the platform 50 swings so that the container C moves to the third station III. The beams close, the vacuum lips are deactivated.

The container C is thus held between the cup and the spear at the third station and the platform 50 swings leftward again so that the container is supported under the third horse from the left at the third station (FIG. 6). The vacuum lips 74 are activated and the beams 24, 26 open leaving the container resting on the third horse. The platform 50 swings rightward (FIG. 7) and the container C is brought into alignment with the cup 36' and the spear 42' at the labeling station.

The angle of the cup 36' at the labeling station IV as shown in FIG. 6 in full lines is such that it matches the canted disposition of the container carried by the third horse. The beams close and the lips 74 are deactivated so that the container is supported between the cup 36' and the spear 42' at the labeling station.

The container C is thus disposed in a position as shown in FIGS. 6, 9 under the mouth or line of application of the label applier. The outlet edge of the labeler is thus in engagement with the rightward side or initial contact line of the working surface of the container, (that is the surface on which the label is to be applied) and the container C is supported at the label station between the cup 36' and the spear 42'.

The rocker arms 130 and 180 then pivot about their coaxial shafts 110 and 172, driven by the belts 120 and 202. The container C is thus manipulated so that its working surface swings about the axis of curvature of the working surface as in FIGS. 9, 11 and 12, and so that the working surface passes smoothly under the stationary mouth or line of application of the label applier whereby the label is smoothly applied to the container C.

The finished container is removed from the supports at the labeling station by means not shown for further processing. It should be clear that the rocker arms 130 and 180 are continuously rocking in the same rhythm as the platform 50 and the beams 24, 26, all driven in synchrony.

Because of the importance of exact synchronized movements of the various components in the apparatus, all drive parts, that is the beam rods 38 and 30, the oscilating shaft 92 and the platform swing arms 56 are driven by means not shown through timing belts linked to a single motor. This assures that these various components will perform properly without interference with other moving components.

The smooth running operation of the apparatus described assures quick application of labels or printing to non-circular containers. Moveover, because of the ingenious structure of the container supports at the labeling station, that support can be quickly set up for a new shaped bottle with a minimum of fuss.

It should be understood that while the invention has been disclosed in a single embodiment, it is not so limited but is susceptible of many variations and modifications, all within the scope of the following claim language or the expansion under the doctrine of equivalents of the right to exclude others.

What is claimed is:

1. A transport and manipulator adapted for use with a device dispensing printing or labeling from a fixed line of application onto a curved work surface on a non-cylindrical container starting at an initial contact line on the work surface comprising:

(a) transport means for engaging the container and moving the container to adjacent the line of application, (b) oscillating manipulator means adjacent the line of application for engaging the container by its top and bottom ends and moving the container about a stationary axis parallel to the line of application and at the center of the arc of curvature of the work surface so that the work surface of the container travels along its own arc of curvature, and where the initial contact line on the container and the line of application coincide the printing or labeling commences so that the application of the printing or labeling progresses smoothly along the work surface as the travel proceeds.

2. A transport and manipulator as claimed in claim 1 wherein the container may be located either above or below said stationary axis whereby the label or printing may be applied to a concave or convex working surface.

3. A transport and manipulator as claimed in claim 1 wherein the oscillating manipulator means comprises a pair of parallel arms, each having means at one end to engage and hold an end of the container, and spaced coaxial opposed rotary fixtures disposed on a fixed axis of rotation, means to secure the fixtures to the arms respectively at selected points on the arms, and means to rock the fixtures about the axis of rotation.

4. A transport and manipulator adapted for use with a device to apply printing or labeling onto a curved surface on a non-cylindrical horizontally disposed container comprising:

(a) a pair of horizontally aligned parallel beams comprising a first and second beam, (b) means to move reciprocally the beams toward each other to a closed position and away from each other to an open position, (c) a row of uniformly spaced container end-gripping units on each beam, the end gripping units on one beam being cup-shaped to engage the bottom end of the containers, the units on the other beam being tapered to engage in the mouth of the top end of the containers, the cup-shaped units on the one beam being respectively aligned across from the tapered units on the other beam to comprise container-supporting sets, (d) an elongate carrier platform disposed between the beams and carrying a plurality of uniformly spaced container horses, (e) means to reciprocate the platform horizontally longitudinally of the beams a distance equal to the distance between adjacent sets, to move the containers serially step-by-step from set to set as the beams open and close, the horses supporting the containers while the beams are open, (f) the final set comprising 1) a pair of aligned coaxial rocker bearings and means mounting them on the respective beams, 2) rocker shafts in the respective bearings, 3) perpendicular rocker arms on the proximate ends of the respective shafts, the arms being parallel to each other, 4) the respective end-gripping units of the final set being aligned and mounted on the arms at a distance spaced from the axis of the bearings so that the axis of curvature of the curved surface on the container is coincident with the axis of the bearings.

5) means to oscillate the shafts in time with the reciprocation of the carrier platform so that the container is gripped in the final set at an end of the oscilation and the shaft is moved to sweep the surface along its arc of curvature during which time the print or label may be applied.

5. A transport and manipulator as claimed in claim 4 wherein the means mounting the bearings are vertically adjustable.

6. A transport and manipulator as claimed in claim 4 wherein the means to oscillate the rocker shafts comprises a horizontal splined drive shaft parallel to the rocker shafts and splined pulleys on the drive shaft and pulleys on the rocker shafts respectively and belts linking the splined pulleys to the respective rocker shafts and oscillating power means driving the splined shaft.

7. A transport and manipulator as claimed in claim 6 wherein the mounting means on the respective beds mount the respective rocker shafts in vertically adjustable fashion and the splined drive shaft is vertically fixed in position and tension maintaining means are provided to keep the tension in the belts as the height of the rocker shafts is adjusted.

8. A transport and manipulator as claimed in claim 7 wherein the mounting means includes a pair of vertically adjustable vertically disposed parallel plates mounted on the respective beds and carrying the rocker shafts respectively and the mounting means also carry the fixed splined pulleys respectively and fixed take-up pulleys respectively spaced for the splined pulleys and the adjustable plates each carry a pair of spaced idlers disposed between the fixed pulleys and the belts are respectively trained over the splined pulleys, the rocker pulley and the take-up pulley and inbetween the spaced idlers to form a T-shaped pattern.

* * * * *